United States Patent [19]

Odom

[11] Patent Number: 4,945,832

[45] Date of Patent: Aug. 7, 1990

[54] DOCTOR BLADE SYSTEM

[76] Inventor: Jimmie L. Odom, Rte. 1, Box 329A, Bailey, Miss. 39320

[21] Appl. No.: 313,353

[22] Filed: Feb. 21, 1989

Related U.S. Application Data

[63] Continuation of Ser. No. 864,054, May 16, 1986, abandoned.

[51] Int. Cl.[5] ..... B41F 31/00

[52] U.S. Cl. ..... 101/350; 101/169; 101/364

[58] Field of Search ..... 101/197, 169, 350, 351, 101/363, 364, 207, 208, 209, 210, 148; 118/413, 261; 15/256.51

[56] References Cited

U.S. PATENT DOCUMENTS

| | | | |
|---|---|---|---|
| 2,377,110 | 5/1945 | Smith . | |
| 2,525,363 | 10/1950 | Luehrs | 101/364 |
| 2,688,919 | 9/1954 | Kaiser . | |
| 2,794,405 | 6/1957 | Vogt | 107/21 |
| 2,920,558 | 1/1960 | Hewlett | 101/364 |
| 2,929,321 | 3/1960 | Newbegin | 101/364 |
| 3,016,826 | 1/1962 | Sage | 101/425 |
| 3,052,183 | 9/1962 | Zernov et al. | 101/364 |
| 3,067,056 | 12/1962 | Remer | 117/36 |
| 3,097,968 | 7/1963 | Schaefer | 118/259 |
| 3,135,197 | 6/1964 | Dutro et al. | 101/364 |
| 3,150,002 | 9/1964 | Justus | 118/249 |
| 3,155,037 | 11/1964 | Haskin, Jr. | 101/364 |
| 3,164,087 | 1/1965 | Owen | 101/142 |
| 3,333,535 | 8/1967 | Behringer . | |
| 3,405,683 | 10/1968 | Jons et al. | 118/637 |
| 3,585,932 | 6/1971 | Granger . | |
| 3,623,965 | 11/1971 | Owren . | |
| 3,630,146 | 12/1971 | Shields | 101/169 |
| 3,641,932 | 2/1972 | Behringer . | |
| 3,730,087 | 5/1973 | Trant et al. . | |
| 3,780,670 | 12/1973 | Abler et al. . | |
| 3,788,220 | 1/1974 | Laben et al. . | |
| 3,793,952 | 2/1974 | Neumann et al. | 101/157 |
| 3,835,779 | 9/1974 | Ross et al. | 101/425 |
| 3,866,266 | 2/1975 | Dunlap . | |
| 3,869,344 | 3/1975 | Hunt | 162/274 |
| 4,080,735 | 3/1978 | Michalski | 30/345 |
| 4,143,110 | 3/1979 | Morozumi et al. | 264/117 |
| 4,147,819 | 4/1979 | Hukumoto et al. | 427/195 |
| 4,151,797 | 5/1979 | Dunsirn | 101/169 |
| 4,165,688 | 8/1979 | Leanna et al. | 101/207 |
| 4,408,527 | 10/1983 | Bell . | |
| 4,414,900 | 11/1983 | Kraus et al. | 101/363 |
| 4,455,938 | 6/1984 | Loudon | 101/363 |
| 4,461,211 | 7/1984 | Wesselmann et al. . | |
| 4,497,250 | 2/1985 | Dressler | 101/305 |
| 4,549,933 | 10/1985 | Judd et al. | 162/281 |
| 4,575,430 | 3/1986 | Periard et al. | 252/12.6 |
| 4,590,855 | 5/1986 | Schommer et al. | 101/350 |
| 4,735,144 | 4/1988 | Jenkins | 101/425 X |

FOREIGN PATENT DOCUMENTS

| | | |
|---|---|---|
| 0071180 | 2/1983 | European Pat. Off. . |
| 604568 | 7/1948 | United Kingdom . |
| 895125 | 5/1962 | United Kingdom . |

*Primary Examiner*—Eugene H. Eickholt
*Attorney, Agent, or Firm*—Laurence R. Brown

[57] ABSTRACT

A rotary machine for printing or otherwise applying ink or other liquidous composition to a rotary receiving roll carried by a frame and having a longitudinal rotational axis and a peripheral surface. One or more doctor blades having a doctoring edge(s) contact the roll peripheral surface. A blade support for the doctor blade includes or is connected to an aligning member having a registration surface which is held in closely confronting or directly contacting relationship with a portion of the peripheral surface and/or with a portion of a projecting member which projects from the roll. The registration surface has a connection with the doctor blade holder for maintaining a substantially fixed radial distance relationship between the holder and the rotational axis of the roll. The amount of operator effort required to adjust the doctor blade is minimized, even when a reservoir which supplies ink or other liquidous composition to the roll is substantially or completely enclosed to prevent escape of noxious vapors into the workplace.

28 Claims, 3 Drawing Sheets

DOCTOR BLADE SYSTEM

This is a continuation of application Ser. No. 06/864,054, filed May 16, 1986 and now abandoned.

TECHNICAL FIELD

The present invention is directed to rotary equipment for applying liquidous compositions. More particularly the invention is directed to rotary printing machines and blade holders for the doctor blades used therein.

BACKGROUND OF THE INVENTION

In the printing arts, rotary machines are used for printing or otherwise applying ink or other liquidous compositions to travelling substrates, including sheets or webs. Such machines conventionally comprise a frame and a rotary receiving roll carried by the frame. Such rolls conventionally have a longitudinal rotational axis and a peripheral surface.

In some instances such receiving rolls act as printing rolls, having indicia formed on their peripheral surfaces for forming a graphic image on the substrate. In other instances, the receiving rolls act as inking, fluid metering or transfer rolls. More particularly, ink is applied to the receiving roll and then transferred from that roll directly or through an intermediate roll or rolls to a printing roll. A frequently used roll of this type is the "anilox" roll, the peripheral surface of which has a variety of tiny, closely spaced, shallow depressions called "cells", and these cells retain ink or other liquidous composition supplied thereto by any appropriate delivering means, such as a bath, fountain or the like.

Doctor blades are used to level and/or remove excess composition from the peripheral surfaces of receiving rolls, including those receiving rolls which act as printing rolls, and those which act as inking, metering or transfer rolls. A doctor blade has a doctoring edge which contacts the peripheral surface of the roll along a line of contact which is usually at least generally parallel to the rotational axis of the roll.

Frequently a doctor blade will be canted, so that one of its surfaces is at an acute angle to a plane which is tangent to the roll peripheral surface along the contact line. If the doctor blade is a flat member or a thin wedge, which is often the case, the other surface of the doctor blade will generally be at an obtuse angle to the above-mentioned plane. When the peripheral surface of the roll approaches the contact line from the acute angle side, its action may be said to resemble wiping. When the surface of the roll approaches the contact line from the obtuse angle side, the action of the doctor blade may be described as scraping, and a blade so mounted can be referred to as a "reverse angle doctor blade". Reverse angle doctor blades may be used alone or in combination with doctor blades disposed in the opposite direction.

One of the most common problems encountered with reverse angle doctor blades is blade chatter, which can be caused by machine vibration, excessive extension of the blades from their holders and mal-adjustment. Thus, numerous precision adjustments must be made by the operator in the attempt to minimize blade chatter and such adjustment is not always sufficient to fully solve the problem.

Another challenge encountered with doctor blade systems is the problem of containment of fluids and fume emissions within the doctoring system. It is possible to provide closed doctoring systems in which both normal and reverse angle doctor blades are applied to the same receiving roll and in which the intervening space between the doctor blades is fully enclosed with the ink supply being maintained between them. While this minimizes the potential for escape of toxic fumes into the workplace surrounding the equipment, the enclosure can also complicate the process of making the numerous and delicate adjustments required to eliminate blade chatter.

Clearly, a need remains for improvements to ameliorate these difficulties. It is an object of the present invention to meet this need.

SUMMARY OF THE INVENTION

The present invention is a rotary machine for printing or otherwise applying ink or other liquidous composition to a traveling substrate. It comprises a frame and a rotary receiving roll carried by the frame. The roll has a longitudinal rotational axis and a peripheral surface. Delivering means are included in the apparatus for delivering the composition to the roll peripheral surface. Also, there is at least one doctor blade having a doctoring edge for contacting the peripheral surface and for levelling the composition and/or removing excess composition from the peripheral surface, as well as a blade support including a blade holder for the doctor blade.

According to the invention, the foregoing combination has a blade support which includes or is connected to an aligning member having a registration surface which is held in closely confronting or directly contacting relationship with a portion of the peripheral surface and/or with a portion of a projecting member which projects from the roll. The registration surface has a connection with the doctor blade holder for maintaining a substantially fixed radial distance relationship between the holder and the rotational axis of the roll. Equipment having the foregoing characteristics yields a number of valuable operational benefits which will be encountered during its use, notable among which is the advantage of minimizing the amount of operator effort required to adjust the doctor blade.

The invention includes a variety of optional but preferred and valuable improvements which are intended to be protected hereby. Among these are additional elements and combinations of elements which may be used in combination with the elements described above, and specific embodiments of certain of the elements and combinations described above. These optional but desireable forms of the invention are described in this Summary of the Invention, or hereinafter in the Description of Preferred Embodiments or in the claims. For example, the above-mentioned machine may be a printing machine and the delivering means may be a device for applying ink to the receiving roll. According to a more preferred embodiment the receiving roll is an inking roll for applying ink to a printing roll, e.g. an anilox roll.

However, in the alternative, it is contemplated that the receiving roll may be a printing roll having indicia formed in its peripheral surface for forming a graphic image on the substrate. As an illustration, the printing roll may be a gravure roll.

Optionally, but preferably, the delivering means includes a reservoir disposed in the blade support for maintaining a supply of the composition in contact with the peripheral surface. One illustrative and particularly preferred way of accomplishing this is to provide the delivery means in a form which comprises a trough member included in the blade support, extending under and adjacent the roll and having a supply cavity disposed between the trough member and the roll to receive a flow of the composition, and in which the delivery means further comprises a supply port to feed into the cavity a sufficient flow of composition to keep the peripheral surface wetted with the composition as the roll rotates through the cavity. Although many embodiments corresponding to the foregoing are possible, it is considered quite advantageous for the blade holder to include a blade bed disposed length-wise on the trough member and clamping means for securing the blade against the bed. The blade bed may for example be formed in an upper edge or in an upward and outward extension of the trough.

A variety of aligning members, registration surfaces and projecting members may be employed. Thus, the aligning member may for example be, and preferably is, an air bearing, and the registration surface encompasses an air discharge port of the air bearing. For example, the registration surface may confront or contact a projecting member which projects from the roll. According to a preferred form of the foregoing, the projecting member is a shaft projecting outwardly from an end of, and in concentric relationship with, the roll. Most preferred are those embodiments wherein the shaft is secured to the roll in rotationally fixed relation with the peripheral surface.

Another preferred embodiment of the invention may be used with or without the particular types of delivery means and blade holder described in a preceding paragraph. This embodiment includes a projecting member which is a shaft projecting outwardly from ah end of and in concentric relationship with the roll; the aligning member is a bracket member at least partially surrounding the shaft; the registration surface is an inner surface of the bracket member which is held in closely confronting or directly contacting relationship with a portion of the shaft; and the bracket means is connected with the blade holder for maintaining a substantially fixed radial distance relationship between the holder and the rotational axis.

One of three alternative forms of the foregoing includes an air bearing and the registration surface encompasses an air discharge port of the air bearing. A second alternative comprises projecting members which are axial shafts projecting outwardly from and in concentric relationship with each end of the roll, and includes aligning members which are bracket members at least partially surrounding each of the shafts. A third alternative has projecting members which are axial shafts projecting outwardly from and- in concentric relationship with each end of the roll, the shafts being secured to the roll in rotationally fixed relation with the peripheral surface, and includes aligning members which are bracket members having registration surfaces which substantially completely surround each of the shafts, the bracket members each including air bearings and the registration surfaces each encompassing air discharge ports of the air bearings.

The following arrangements may be used with any of the various embodiments of the invention, particularly with either the second alternative or the third alternative mentioned in the preceding paragraph. Thus, the bracket members may constitute end closures for opposite ends of the trough member. If desired, and preferably, the bracket members may be removably attached to the trough member. According to a particularly preferred embodiment, the bracket members bear against the trough member through compressible seals-disposed between the bracket members and the trough member, and are removably attached to the trough member. Moreover, the removably attached combinations may be removably attached to the trough member by screws having rotating, means which suspend rotating of the screws at a predetermined level of applied torque.

A particularly desireable combination is one in which the receiving roll is an anilox roll having minute, random or regular depressions distributed on the peripheral surface for receiving the liquidous composition, the blade support is a trough member extending under and adjacent the roll and having a supply cavity disposed between the trough member and the roll to receive a quantity of the composition sufficient to bring the composition into contact with the roll as it rotates, the blade holder includes a blade bed disposed length-wise in the trough member and clamping means for securing the blade against the bed,.the aligning member is an air bearing, the registration surface encompasses an air discharge port of the air bearing, the aligning member confronts or contacts a projecting member which projects from the roll, and the projecting member is an axial shaft projecting outwardly from and in concentric relationship with the roll. Additional worthwhile and desireable embodiments considered to be part of the invention are described below.

DESCRIPTION OF PREFERRED EMBODIMENTS

Figure 1:
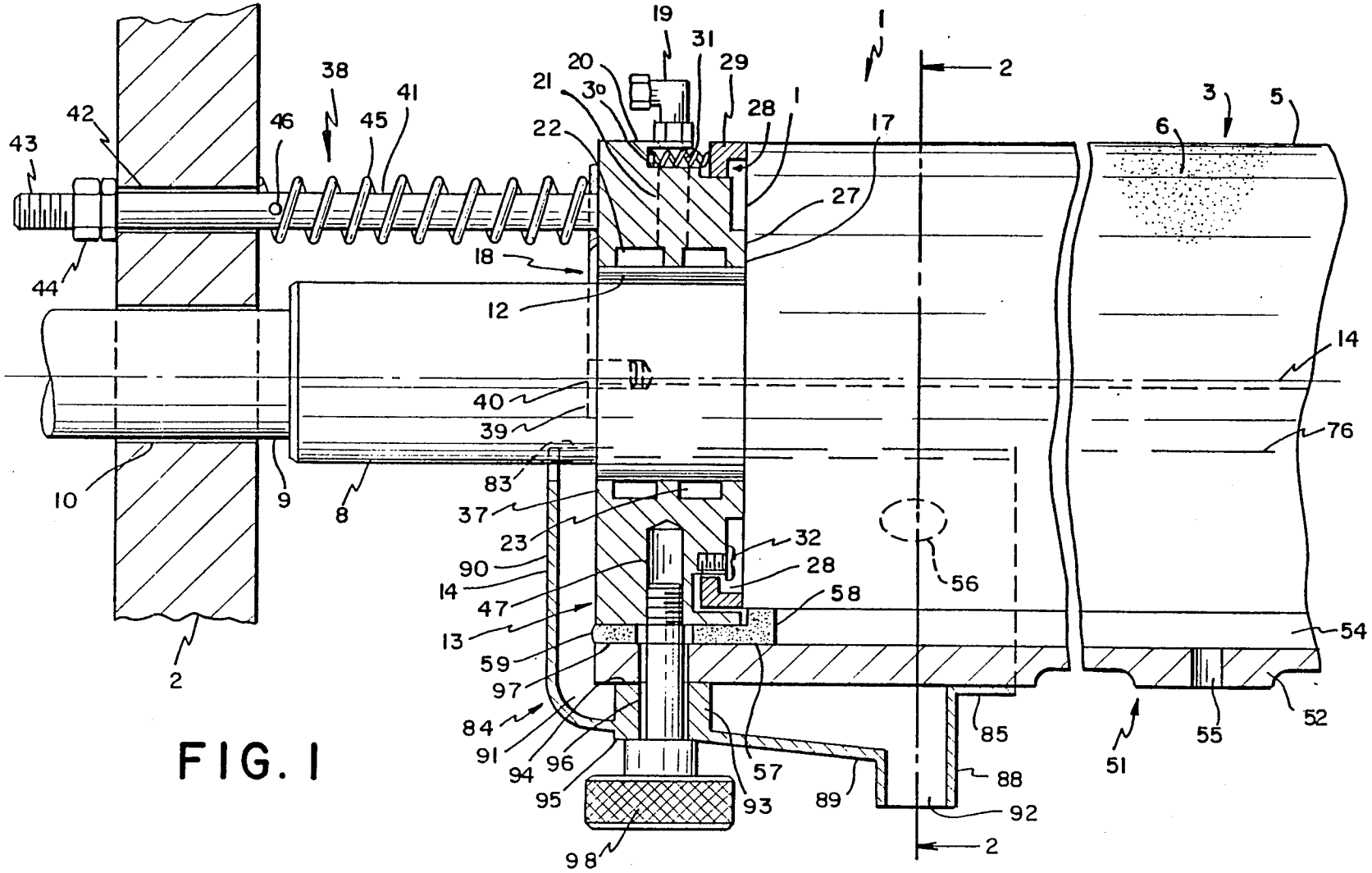
FIG. 1 is a vertical, transverse cross section through a portion of a rotary printing machine showing a portion of its frame and a rotary receiving roll equipped with the doctor blade arrangement if the present invention.
Figure 2:
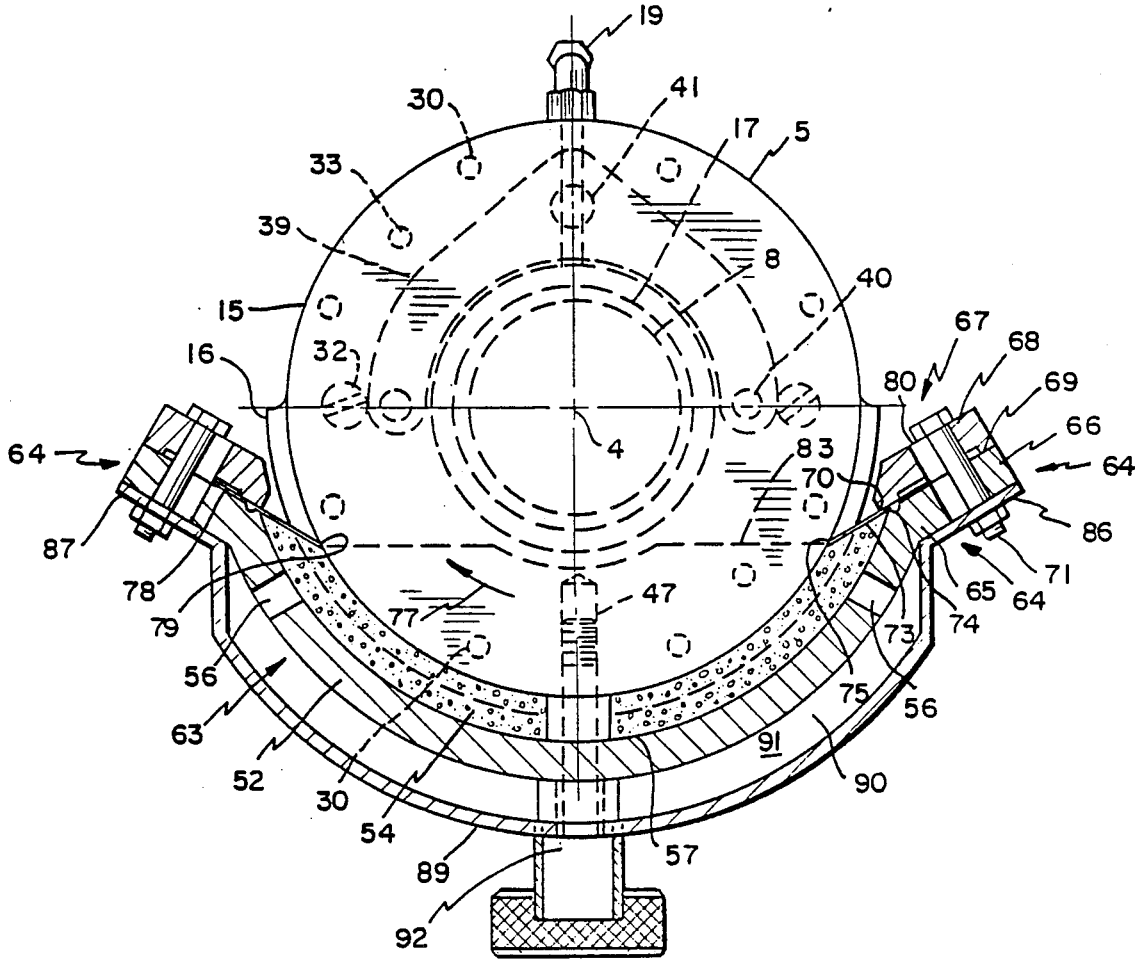
FIG. 2 is a transverse cross section through FIG. 1 taken on section line 2—2.

The printing machine 1 of FIGS. 1 and 2 includes a frame 2 in which is mounted a receiving roll 3, which may be a printing, inking, transfer or metering roll or any other type of roll, whether metal-faced, rubber-faced or of any other composition, which is adapted to receive and transfer ink or other liquidous composition. For purposes of the present invention, a liquidous composition is any composition (such as an ink, ink paste, adhesive or other composition) which is at least partly composed (including major or minor proportions) of material(s) that are liquid or at least semi-liquid under operating conditions, and which is capable of sufficient flow under such conditions to be applied to and transferred from a receiving roll to another roll or a substrate in a manner which is practically controllable with respect to amount and placement; this includes compositions which are and are not liquid, and those which are and are not flowable, under ambient conditions (unagitated, at 20° Centigrade). For purposes of this invention a substrate is any material receptive to application of a liquidous composition from a rotating roll under any practical operating conditions for the substrate, roll and composition, including for example paper and polymeric films in the form of webs, sheets and the like.

Roll 3 has a longitudinal axis 4 and a peripheral surface 5. When roll 3 is an anilox roll, which represents a particularly preferred embodiment of the present invention, peripheral surface 5 has minute, random or regular depressions 6 referred to as cells which receive and transport ink. The drawing shows only a limited number of such cells, it being understood that such cells may be distributed over the entire peripheral surface 5 or over selected portions thereof in any desired arrangement, including for example circumferential bands or patterns corresponding to patterns in a printing roll with which the anilox roll cooperates.

Roll 3 has a pair of roll end faces 7, only one of which is shown in this view. A variety of projecting members may be formed on the roll, preferably on or near the roll end face 7, and may serve, among other functions, the function of supporting the blade support to be described hereinafter. For example, such projecting members may constitute rings or flanges of varying diameters projecting in an endwise direction from end face 7 and having an outer diameter equal to or less than the diameter of the roll itself. There may also be outward (e.g., radial) projections from the peripheral surface, preferably near the roll ends. The projecting members may also be a wall or walls of one or more depression(s) formed in peripheral surface 5 or end face 7.

However, according to a particularly preferred embodiment, the projecting member employed in the present invention is an axial shaft, or pair of shifts (only one being shown to permit enlargement of the view), protruding from the roll end faces and concentric with the roll longitudinal axis 4. The shaft or shafts may be connected with the roll in such manner that the roll may rotate relative to the shaft(s). However, according to the presently preferred embodiment, the projecting members are axial shafts 8 which are secured in rotationally fixed relationship with the roll peripheral surface 5. Thus, the shafts and roll proper may be turned from a single piece of metal stock. In the alternative, and more preferably, peripheral surface 5 is part of a cylindrical member which is plugged at each and by disks, and the shafts are integral portions of these disks.

Shaft 8 is mounted for rotation in the frame in any suitable manner, it being understood that the design and construction of suitable mounts is well within the skill of those working in the art. For example, the reduced diameter portion 9 of shaft 8 may be journalled in any suitable bearing (not shown) fitted into an enlargement of frame aperture 10.

A portion of shaft 8 or of such other- projecting member as may be present on roll 3 is closely confronted and/or directly, contacted by a registration surface of an aligning member 13. While the aligning member may take any desired form, in its preferred embodiment it is a journal mounted member in the form of a collar 14 having an upper half 15 which has the same diameter as roll 3 and a lower half 16 of slightly increased diameter as best shown in FIG. 2. Collar 14 has an inner surface 17 which constitutes the registration surface of this embodiment. An air bearing 18 is formed within collar 14 having an external fitting 19 which provides access through collar outer surface 20 to a radial internal passageway 21 leading to air discharge ports 22 and 23 encompassed by registration surface 17.

While it is not necessary that collar 14 abut roll end face 7, it is advantageous for it to do so, and such arrangement is preferred. Thus, the collar has an end face 27 referred to as the inner end face, which is closely adjacent to roll end face 7. At the periphery of collar upper half 15, and adjacent the collar lower half 16 is an annular groove 28 which contains a face seal 29. Bores 30 disposed generally perpendicular to inner end face 27 and in communication with groove 28 contain loading springs 31 which urge face seal 29 in the direction of roll end face 7

In order that an exemplary bore 30 and its loading spring 31 may be clearly shown in cross section in FIG. 1, it has been moved from its actual position which is shown in FIG. 2. The passageway 21 of FIG. 1, which should be appear in cross section therein, has been shown in phantom to avoid the appearance of interference with bore 30.

Excessive travel of face seal 29 towards roll 3 is prevented by face seal retainer screws 32, which are positioned as shown in dotted outline in FIG. 2, the showing of one of these retainer screws having been rotated 90° about the roll axis in FIG. 1 to facilitate its illustration. Undesired rotation of ,face seal 29 is prevented by a pair of anti-rotation pins 33 secured to the back of the face seal and protruding into corresponding bores in collar 14 at the positions shown in FIG. 2.

Drag exerted by face seal 29 against roll end face 7 tends to cause rotation of collar 14. To prevent such rotation, the collar outer end face 17 is fitted with an anti-rotation bracket 38. This includes a wishbone plate 39 secured by studs 40 to outer end face 37. Cylindrical bar 41 is fixedly secured to the upper portion of wishbone plate 39 and extends across the intervening space between wishbone plate 39 and frame 2. Bar 41 extends through and freely reciprocates in an aperture 42 in frame 2, in which bar 41 is held in place by a pair of jammed nuts 44 installed on threaded end 43 of the bar. By means of a coil spring 45 surrounding bar 41 and compressed between frame 2 and collar outer end face 37, collar 14 is urged toward roll 3. Through adjustment of nuts 44, the pressure of collar 14 against rOll end face 7 can be regulated. In order to facilitate withdrawal of the collar from contact with the roll, such as for cleaning of the space between them, bar threaded end 43 may be fitted with a knob (not shown) which may be grasped and pulled away from the frame to withdraw the collar against the action of the spring 45. When hole 46 in rod 41 has passed through aperture 42 to the opposite side of the frame 3, pin may be temporarily inserted into hole 46 to retain the collar in withdrawn condition until work has been completed and the unit is ready to be returned to operation.

In a typical installation, the roll 3 will include two shafts 8 and be provided with a pair of the above-mentioned bracket members 14, one associated with each of the shafts. The doctor blade holders may be part of or directly or indirectly connected to these brackets, and may also be completely independent of the delivering means for supplying ink or other liquidous composition to the receiving roll. However, according to a particularly preferred embodiment, bracket members 14 are removably attached to, or may constitute a portion of, the delivering means. For this purpose, the collars 14 are provided with radial bores 47 that are threaded, and may be used in a manner to be described hereinafter.

According to a particularly preferred embodiment, the delivering means 51 includes a reservoir, for ink or other liquidous composition, which is preferably part of the blade support. For example, the reservoir may be defined at least in part by a trough member 52 which in this preferred embodiment has an arcuate cross-section and an arcuate upper surface. The lower portion of the roll peripheral surface 5 is spaced a short distance above the upper surface of the trough member. By way of illustration and not limitation, this distance may be about one and one quarter (1.25) centimeters (about one half (0.5) inch) when the roll diameter is about sixteen and one half (16.5) centimeters (about six and one half (6.5) inches). This same spacing of about one and one quarter centimeters is recommended for use with rolls and troughs of larger and smaller diameter.

The above-described narrow space defines in part a supply cavity 54 into which the aforementioned composition is delivered through a supply port 551 Preferably, the rate of supply of liquidous composition to supply cavity 54 is at least to some extent in excess of the actual requirements, so that there is a more or less constant overflow of such composition through an overflow part 56. The ends of the supply cavity are defined by compressible seals 57, which may for example be a closed cell silicone foam having an inner leg 58 compressed between trough member 52 and roll peripheral surface 5 and an outer leg 59 compressed between trough member 52 and the lower half 16 of collar 14.

According to the present preferred embodiment, the trough 52 is the main structural member of the blade support 63, in which the blade holder 64 constitutes an upper edge or an upward and outward extension 65 of trough 52. Extension 65 includes a blade bed 66 extending the entire length of extension 65. Preferably, as shown in this embodiment, the trough member is a rigid member, the blade holder 64 is a rigid member integral with, or fixedly secured in or to, the trough member, and the blade holder also includes clamping means 67 which in this case is an elongated bar 68 with machined lower faces 69 and 70 which respectively contact blade bed 66 and doctor blade 73. By means of through-bolts 71 extending through corresponding holes in extension 65, bar 68 clamps blade 73 between face 70 and an 0-ring seal 74 which, like blade 73 and bar face 70, extend the entire length of blade bed 66 and extension 65.

As best shown in FIG. 2, doctor blade 73 has a doctoring edge 75 which contacts the roll peripheral surface 5 along contact line 76, which may be seen in FIG. 1. To align doctoring edge 75 accurately with peripheral surface 5, the back edge (the opposite longitudinal edge) of the doctor blade contacts a pair of guide pins 80 which pass through close-fitting holes in both the trough extension 65 and the bar 68. Pins 80 are widely separated from one another in the longitudinal direction along extension 65, to enhance the precision of the placement of the doctor blade.

As indicated by directional arrow 77 in FIG. 2, the roll peripheral surface 5 rotates away from doctoring edge 75. A similar blade 78 having doctoring edge 79 is secured by a holder 64 along the other upper edge of trough 52. Doctor 78 is a reverse doctor blade by virtue of the fact roll peripheral surface rotates towards its doctoring edge 79. Preferably, the doctoring edges of the two blades are opposed to one another, e.g. they face inward toward the central portion of the supply cavity. One of th advantages which may be obtained with this embodiment of invention, in which the two doctor blades are maintained at substantially the same or substantially similar angle radial lines drawn through their doctoring edges, with having its doctoring edge facing clockwise and the other counterclockwise, is that rotation of the roll 3 may be without adjustment or reversal of the doctor blades.

Together, the lower portion of roll 3, the two doctor blades 73 and 78, the compressible seals 57 at both ends of the roll and trough 52 can, and in many embodiments will, define a completely enclosed and sealed supply cavity 54 which prevents vaporized ink solvents and other toxic or disagreeable fumes from the printing ink or other liquidous composition from escaping into the surrounding work space. In this connection it should be noted that overflow ports 56 can be connected through a completely enclosed conduit system to a closed storage or recovery tank for the ink or other composition.

Because some minor seepage of liquid ink can occur at the interface between compressible seals 57 and the adjoining portions of roll 3 and collar 14, an overflow return shroud 84 may be provided at each end of trough 52. According to a preferred embodiment, this shroud includes a flange portion 85 which has limbs 86, 87 that may be secured to the trough in any convenient fashion, such as may through-bolts 71 which hold the doctor blade clamps. Flange portion 85 fits closely and is sealed against the underside of trough member 52. At one end, flange portion 85 blends into an annular inner end or standoff 88 which supports an arcuate skirt portion 89 and end cap 90 in spaced relationship with the end of trough 52 and the outer end face 37 of collar 14 to define a collection chamber 91 for catching the above-mentioned seepage. The same chamber can also catch the discharge from overflow ports 56, as well as catching spillage of left-over ink from supply cavity 54 when the trough member is removed from the machine.

End cap 90 can and preferably should enlarged in some circumstances so that its upper edge 83 is at a higher elevation than is shown, e.g. lever with the upper ends of the blade beds 66. This is useful for example when the upper ends of the compressible seals 57 (FIG. 2) are positioned a short distance below the doctor blade lower surfaces, leaving small openings (not shown) beneath and adjacent the doctor blades which connect supply cavity 54 to collection chamber 91. Such openings can be employed for overflow in addition to or in lieu of overflow ports 56.

Bushing 93, formed in arcuate skirt portion 89, has inner and outer faces 94 and 95 and is penetrated by a bore 96 in alignment with radial bore 47, mentioned above. Screw 97, extending through bore 96 and corresponding hole in compressible seal 57 extends into bore 47 and secures trough 52 to collars 14 while also assisting in holding overflow return shroud 84 in place. Screws 97 have torque handles 98 which may be set to suspend rotation of the screws 97 at a predetermined and preferably adjustable level of applied torque. By selecting the appropriate level of applied torque, one may apply the desired pressure between the doctor blade doctoring edges 75 and 79 and the receiving roll peripheral surface 3.

Figure 3:
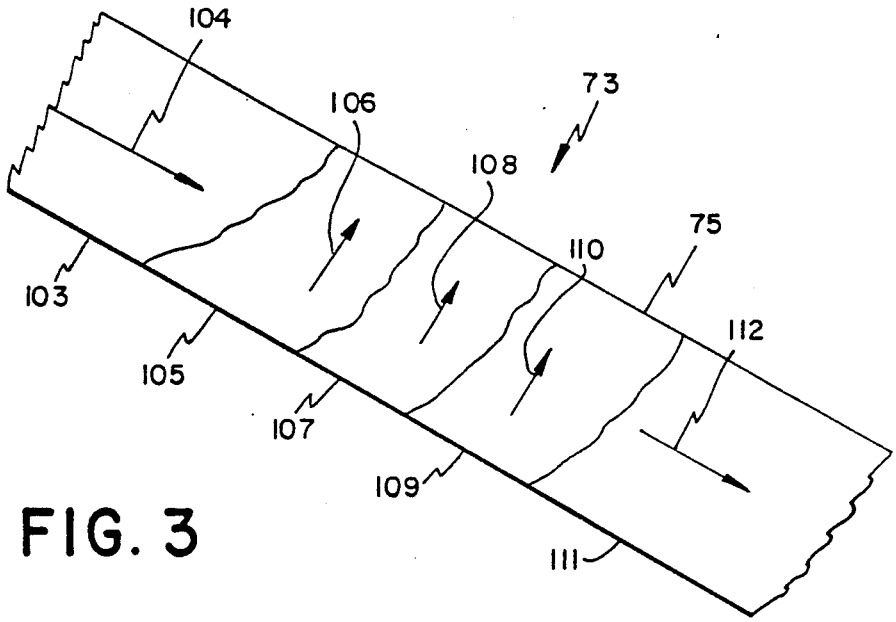
FIG. 3 is a schematic diagram, in perspective, showing the fiber reinforcement design of a preferred form of synthetic resinous doctor blade.

FIG. 3 provides additional details concerning a particularly preferred form of doctor blade for use in the present invention. The figure shows, in perspective, a schematic diagram looking down upon the upper surface of a short section of the length of doctor blade 73 of FIG. 2. The doctoring edge 75 of this blade extends along the upper right hand edge of the fragment in FIG.

3. This view illustrates a fiber reinforced resin composite having bidirectional fiber reinforcement.

According to a particularly preferred embodiment the above-mentioned composite is laid up from multiple layers of fiber reinforced resin which are fused together by heat and compression. More specifically, as shown in FIG. 3, doctor blade 75 is composed of a first layer 103 comprising Phillips Petroleum Company Ryton (TM) synthetic resin having closely spaced parallel graphite fiber reinforcement embedded therein and oriented in the direction indicated by arrow 104. Second, third and fourth layers 105, 107 and 109 are arranged in sequential order beneath layer 103 and have their fibers oriented in the direction indicated by arrows 106, 108 and 110. A fifth layer 111, representing the bottom of the doctor blade, is arranged beneath fourth layer 109 and has its fibers oriented in the direction indicated by arrow 112. It will be appreciated that in actual practice all of the layers will be coextensive in length and width, so that their edges are coincident. However, portions of the successive layers have been removed in the view to facilitate illustration of the fiber orientation.

When the various layers have been laid up with the fibers oriented in the manner described the layers are placed between rigid, flat metal plate, and are heated to a sufficiently elevated temperature, e.g. about three hundred seventy degrees (370°) Centigrade (about seven hundred degrees (700°) Fahrenheit), and are squeezed together under sufficient compression, to cause the adjoining surfaces of the respective layers to fuse together, whereby the five layers become a unitary composite having bi-directional fiber reinforcement, including outer layers containing fibers generally parallel to the doctoring edge and plural inner layers having fibers oriented generally perpendicular to the doctoring edge.

Figure 4:
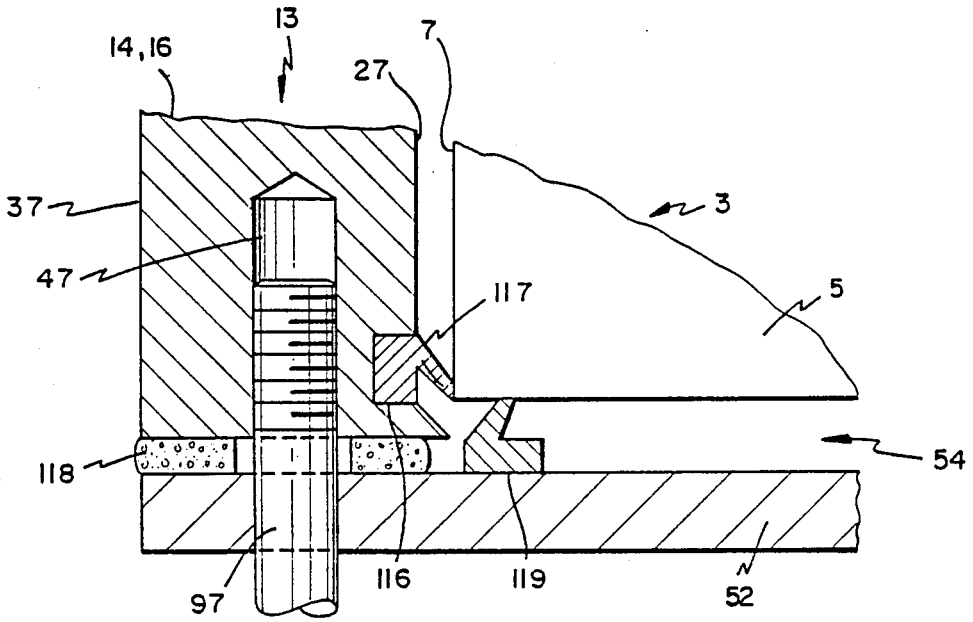
FIG. 4 is an enlarged and modified portion of FIG. 2, showing an alternative form of roll face sealing arrangement.

A particularly preferred form of composite of this type is commercially available and is identified as Phillips-66 (TM) Ryton (TM)-PPS, AC 40-60 laminate. This material is available in a variety of widths suitable for doctor blade use, a width of about three and eight tenths (3.8) centimeters (about one and one half (1½) inches) being preferred for use in the embodiment disclosed herein. It appears that the stiffness of this particular composite is adequate for liquidous composition having viscosities up to about 45 seconds (measured in a number five (5) Zahn cup). Stiffer composites may possibly be required for more viscous compositions. FIG. 4 discloses an alternative to the face seal 29 used in the embodiment of FIGS. 1 and 2. FIG. 4 depicts an enlarged portion of a unit which is identical to that shown in FIGS. 1 and 2 except for the differences apparent in FIG. 4 The portions of this alternative embodiment visible in FIG. 4 include some elements identical to those shown in FIGS. 1 and 2, including a portion of receiving roll 3 with peripheral surface 5 and roll end face 7; the aligning member which is a journal mounted bracket member or collar 14 having lower half 16, inner end face 27, outer end face 37 and radial bore 47; and portions of the delivering means, including portions of trough member 52 and supply cavity 54, and screw 97 for securing trough member 52 to collar 14.

However, in the FIG. 4 embodiment, annular groove 28 of FIG. 1 is replaced by a simpler annular groove 116 in which is mounted face seal 117, replacing face seal 29 of FIG. 1. Face seal 117 may be secured in groove 116 by adhesive or any other suitable means (not shown and has a protruding flexible or resilient lip which contacts the roll end face 7 near its peripheral edge. By virtue of the simplicity of this seal arrangement, the bores 30, face seal loading springs 31, face seal retainers 32 and face seal anti-rotation pins 33 of FIGS. 1 and 2 may be dispensed with. In FIG. 4, the compressible seal 57 of FIGS. 1 and 2 is replaced by a compressible seal 118 which has no inner leg 58. Instead, the function of inner leg 58 is performed by a supply seal 119 which is secured by an adhesive or by a suitable mechanical retainer (not shown) to the inner surface of trough member 52. Supply seal 119 has a resilient or flexible lip similar to that in face seal 117 which contacts roll peripheral surface 5 near the and of the roll. Although not shown in the drawing, it will be appreciated that a construction similar to that shown in FIG. 4 will be provided at each end of roll 3.

The foregoing are but a few of many possible embodiments of the invention. Therefore, it should be understood that the foregoing disclosure is offered by way of illustration and not limitation and that it is desired to protect the entire subject matter falling within the literal scope of the appended claims, and the equivalents thereof.

I claim:

1. Apparatus for applying a liquid to a travelling substrate, said apparatus comprising: a frame, a first roll rotatably carried by said frame and having a longitudinal rotational axis and a peripheral surface for applying the liquid to a surface of the substrate, a second roll rotatably carried by said frame and having a longitudinal axis parallel with the longitudinal axis of said first roll and adapted to be in contact with the peripheral surface of said first roll, reservoir means carried by and suspended from said second roll and supported independently of said frame, said reservoir means adapted to receive the liquid and to maintain the liquid in contact with the peripheral surface of the second roll, delivering means for delivering the liquid to said reservoir means, at least one doctor blade having a doctoring edge for contacting said peripheral surface of said second roll and for levelling the liquid on said second roll peripheral surface, and doctor blade support means carried by the reservoir means and including a blade holder for holding said doctor blade, wherein said reservoir means maintains a substantially fixed radial distance between said doctor blade support means and said longitudinal axis of said second roll.

2. Apparatus according to claim 1 wherein said apparatus is a printing machine and said delivering means supplies printing ink to be applied to second roll.

3. Apparatus according to claim 1 wherein said second roll is an inking roll for applying ink to said first roll and said first roll is a printing roll.

4. Apparatus according to claim 3 wherein said second roll is an anilox roll.

5. Apparatus according to claim 1 wherein said first roll is a printing roll having indicia formed in said first roll peripheral surface for forming a graphic image on said substrate.

6. Apparatus according to claim 5 wherein said printing roll is a gravure roll.

7. Apparatus according to claim 1 wherein said reservoir means is positioned adjacent said second roll and defines a supply cavity disposed to allow said second roll to receive a flow of said liquid, and said delivery means further comprises a supply port in said reservoir means to feed a sufficient flow of liquid to keep said peripheral surface of said second roll wetted with said liquid as said second roll rotates relative to said cavity.

8. Apparatus acccording to claim 1 wherein said reservoir means is carried on said second roll on an air bearing.

9. Apparatus according to claim 1 wherein said second roll includes an end shaft projecting outwardly from each end of, and in concentric relationship with, said second roll, and said reservoir means is carried by said end shafts.

10. Apparatus according to claim 9 wherein said end shafts are secured to said second roll in rotationally fixed relation with said second roll peripheral surface.

11. Apparatus according to claim 1 wherein said second roll is an anilox roll having a plurality of depressions distributed on said second roll peripheral surface for receiving such liquid, said doctor blade support means includes a blade bed disposed length-wise on said reservoir means, and clamping means for securing the doctor blade against said bed.

12. An ink metering system for a rotating ink roll having a shaft journalled in the frame of an inking system, the ink metering system comprising:

a first doctor blade;

means for supporting the first doctor blade on the shaft of th e ink roll so that the first doctor blade contacts the ink roll at a uniform pressure independent of relative movement between the ink roll and the frame, the supporting means including bearing means in contact with the shaft at each end of the ink roll to permit relative rotation between the supporting means and the shaft, the bearing means including sealing means for minimizing the passage of ink past the bearing means; and means for contacting the ink roll at a position spaced from the first doctor blade, the contacting means supported by the supporting means, wherein the first doctor blade, the contacting means, the supporting means form housing means surrounding a portion of the ink roll for containing ink between the housing means and the ink roll.

13. The system of claim 12 wherein the contacting means is a second doctor blade.

14. The system of claim 12 wherein the first doctor blade is mounted at an angle of about 30% from a tangent line of the ink roll in the direction of rotation.

15. The system of claim 13 wherein the second doctor blade is mounted at an angle of about 30% from a tangent line of the roll opposite the direction of rotation.

16. The system of claim 12 wherein the supporting means includes an outer shell on which the first doctor blade is mounted and a compressible member mounted between the outer shell and the bearing means.

17. The system of claim 12 including means for adjusting the pressure of the first doctor blade against the ink roll.

18. The system of claim 16 including means for adjusting the pressure of the first doctor blade against the ink roll.

19. The system of claim 12 wherein the first doctor blade is formed from a resinous material containing fibers oriented substantially orthogonal to the shaft of the ink roll.

20. The system of claim 19 wherein the fibers include graphite.

21. Th system of claim 12 wherein the first doctor blade comprises a plurality of laminated sheets of resinous material.

22. The system of claim 21 wherein at least one of the sheets includes fibers oriented substantially orthogonal to the shaft of the ink roll.

23. The system of claim 22 wherein a majority of the sheets includes fibers oriented substantially orthogonal to the shaft of the ink roll.

24. The system of claim 23 wherein at least one sheet includes fibers oriented substantially parallel to the shaft of the ink roll.

25. An ink metering system for a rotating ink roll having a shaft journalled in the frame of an inking system, the ink metering system comprising:

a first doctor blade;

means for supporting the first doctor blade on the shaft of the ink roll so that the first doctor blade contacts the ink roll at a uniform pressure independent of relative movement between the ink roll and the frame, wherein the supporting means includes an outer shell on which the first doctor blade is mounted and a compressible member mounted between the outer shell and the bearing means, the supporting means further including bearing means in contact with the shaft at each end of the ink roll to permit relative rotation between the supporting means and the shaft, the bearing means including sealing means for minimizing the passage of ink past the bearing means;

means for adjusting the pressure of the first doctor blade against the ink roll, wherein the adjusting means includes a pair of screws, each screw having one end anchored in a bearing means, an intermediate portion of the screw passing through the compressible member and the outer shell, and an adjustment knob means mounted on the other end of the screw and rotatable for varying the pressure of the first doctor blade against the ink roll by varying the pressure exerted against the outer shell by the adjustment knob; and means for contacting the ink roll at a position spaced from the first doctor blade, the contacting means supported by the supporting means, wherein the first doctor blade, the contacting means, and the supporting means form housing means surrounding a portion of the ink roll for containing ink between the housing means and the ink roll.

26. Ink applying apparatus for applying printing ink to the outer surface of an inking roll, said apparatus comprising:

(a) a frame;

(b) an inking roll rotatably carried in the frame for rotation about a longitudinal axis, the inking roll having a peripheral surface adapted to transfer printing ink to a second surface;

(c) ink reservoir means suspended from and carried by the inking roll, the reservoir means adapted to receive printing ink from a supply means and to permit passage of the inking roll peripheral surface through the printing ink in the reservoir means, the reservoir means spaced from and supported independently of the frame to prevent transmission of frame vibrations directly from the frame to the reservoir means; and (d) doctor blade means carried by the reservoir means and in contact with the peripheral surface of the inking roll to control the thickness of an ink film carried by the inking roll.

27. Ink applying apparatus in accordance with claim 26 wherein the ink reservoir means includes end closure means to define a closed, ink receiving and ink holding container.

28. Ink applying means in accordance with claim 27 including anti-rotation means carried by the ink reservoir means for limiting rotation of the reservoir means relative to the frame means.

* * * * *